US010847935B2

(12) United States Patent
Young et al.

(10) Patent No.: US 10,847,935 B2
(45) Date of Patent: Nov. 24, 2020

(54) ELECTRICAL CONTACTS WITH ELECTRICALLY CONDUCTIVE SPRINGS

(71) Applicant: Bal Seal Engineering, LLC, Foothill Ranch, CA (US)

(72) Inventors: Wayne Young, Voorhout (NL); Robert Riegen, Zaandam (NL)

(73) Assignee: Bal Seal Engineering, LLC, Foothill Ranch, CA (US)

( * ) Notice: Subject to any disclaimer, the term of this patent is extended or adjusted under 35 U.S.C. 154(b) by 0 days.

(21) Appl. No.: 16/384,776

(22) Filed: Apr. 15, 2019

(65) Prior Publication Data

US 2019/0237909 A1 Aug. 1, 2019

Related U.S. Application Data

(63) Continuation of application No. 14/313,947, filed on Jun. 24, 2014, now Pat. No. 10,263,368.

(60) Provisional application No. 61/838,973, filed on Jun. 25, 2013.

(51) Int. Cl.

| | |
|---|---|
| ***H01R 13/6583*** | (2011.01) |
| ***H01R 12/71*** | (2011.01) |
| ***H01R 13/24*** | (2006.01) |

(52) U.S. Cl.

CPC ..... *H01R 13/6583* (2013.01); *H01R 12/716* (2013.01); *H01R 13/2421* (2013.01)

(58) Field of Classification Search

CPC ..... H01R 12/716; H01R 13/6583; H01R 13/2421; F16F 1/04; F16F 1/065; F16F 1/045; F16B 21/073

See application file for complete search history.

(56) References Cited

U.S. PATENT DOCUMENTS

| | | | |
|---|---|---|---|
| 3,174,500 | A | 3/1965 | Johnson et al. |
| 4,469,104 | A | 9/1984 | Peers-Trevarton |
| 4,678,210 | A | 7/1987 | Balsells |
| 4,810,213 | A | 3/1989 | Chabot |

(Continued)

FOREIGN PATENT DOCUMENTS

| | | |
|---|---|---|
| DE | 19807663 | 9/1999 |
| GB | 2194298 | 3/1988 |
| WO | WO 03067713 | 8/2003 |

OTHER PUBLICATIONS

Non-Final Office Action on co-pending (U.S. Appl. No. 14/313,947) dated Aug. 8, 2016.

(Continued)

*Primary Examiner* — Briggitte R. Hammond

(74) *Attorney, Agent, or Firm* — Klein, O'Neill & Singh, LLP

(57) ABSTRACT

A face to face contact assembly having at least one electrically conductive spring element and at least one shielding spring element separated from one another by a spacing element. From the perspective of a centerline and extending radially outwardly, electrically conductive spring element is located closest to the centerline, then the spacing element, and then the shielding spring element. The electrically conductive spring element electrically connects two adjacent faces, which in one example can be adjacent printed circuit boards, and the shielding spring element at least partially shields such electrical connection. Other face to face contact assembly arrangements are also disclosed.

27 Claims, 11 Drawing Sheets

(56) References Cited

U.S. PATENT DOCUMENTS

| | | | | |
|---|---|---|---|---|
| 4,872,710 | A | 10/1989 | Konecny et al. | |
| 5,007,842 | A | 4/1991 | Deak et al. | |
| 5,030,109 | A | 7/1991 | Dery | |
| 5,035,628 | A | 7/1991 | Casciotti et al. | |
| 5,273,438 | A | 12/1993 | Bradley et al. | |
| 5,411,348 | A | 5/1995 | Balsells | |
| 5,479,320 | A | 12/1995 | Estes et al. | |
| 5,545,842 | A | 8/1996 | Balsells | |
| 5,570,719 | A | 11/1996 | Richards et al. | |
| 5,992,856 | A * | 11/1999 | Balsells | F16J 15/3236 277/553 |
| 6,161,838 | A | 12/2000 | Balsells | |
| 6,666,690 | B2 | 12/2003 | Ishizuka et al. | |
| 6,672,565 | B2 | 1/2004 | Russell | |
| 6,835,084 | B2 | 12/2004 | Poon et al. | |
| 6,895,276 | B2 | 5/2005 | Kast et al. | |
| 7,538,289 | B2 | 5/2009 | Carroll | |
| 7,722,415 | B2 | 5/2010 | Changsrivong | |
| 7,914,315 | B2 | 3/2011 | Kuhn et al. | |
| 7,914,351 | B2 | 3/2011 | Balsells et al. | |
| 8,052,459 | B2 | 11/2011 | Smith et al. | |
| 8,091,226 | B2 * | 1/2012 | Sjostedt | A61N 1/3752 29/874 |
| 8,096,842 | B2 | 1/2012 | Poon et al. | |
| 8,167,660 | B2 | 5/2012 | Dilmaghanian et al. | |
| 8,308,167 | B2 | 11/2012 | Balsells et al. | |
| 8,382,532 | B2 | 2/2013 | Sjostedt et al. | |
| 8,491,346 | B2 | 7/2013 | Sjostedt et al. | |
| 8,561,274 | B2 | 10/2013 | Balsells | |
| 8,844,126 | B2 | 9/2014 | Frederick et al. | |
| 9,004,805 | B2 | 4/2015 | Changsrivong et al. | |
| 9,011,169 | B2 | 4/2015 | Russell et al. | |
| 9,267,526 | B2 | 2/2016 | Balsells | |
| 9,284,970 | B2 | 3/2016 | Dilmaghanian et al. | |
| 9,312,630 | B2 | 4/2016 | Huang | |
| 9,482,255 | B2 | 11/2016 | Changsrivong et al. | |
| 9,500,211 | B2 | 11/2016 | Changsrivong | |
| 9,534,625 | B2 | 1/2017 | Balsells | |
| 9,677,587 | B2 | 6/2017 | Changsrivong et al. | |
| 2002/0122690 | A1 | 9/2002 | Poon et al. | |
| 2003/0096526 | A1 | 5/2003 | Balsells | |
| 2004/0002234 | A1 | 1/2004 | Masao et al. | |
| 2006/0228166 | A1 | 10/2006 | Balsells | |
| 2010/0233896 | A1 | 9/2010 | Dilmaghanian | |
| 2010/0279558 | A1 | 11/2010 | Leon et al. | |
| 2011/0124245 | A1 | 5/2011 | Fujita et al. | |
| 2012/0208407 | A1 | 8/2012 | Leon et al. | |
| 2012/0315798 | A1 | 12/2012 | Poon et al. | |
| 2013/0149031 | A1 | 6/2013 | Changsrivong et al. | |
| 2014/0130329 | A1 | 5/2014 | Changsrivong et al. | |
| 2014/0162487 | A1 | 6/2014 | Frederick et al. | |
| 2014/0378008 | A1 | 12/2014 | Young et al. | |
| 2015/0018909 | A1 | 1/2015 | Rebentisch et al. | |
| 2016/0076568 | A1 | 3/2016 | Dilmaghanian et al. | |
| 2016/0204557 | A1 | 7/2016 | Kim | |
| 2016/0265574 | A1 | 9/2016 | Ghasiri | |
| 2017/0352984 | A1 | 12/2017 | Changsrivong et al. | |
| 2017/0373425 | A1 | 12/2017 | Rust | |

OTHER PUBLICATIONS

Bal Seal Canted Coil Springs, Circular and Spring Lengths for Radial and Axial Loading, Calatog No. DM3Mm, Rev. A, Jul. 17, 1992, Bal Seal Engineering Company, Inc., Santa Ana, CA, U.S.A., (24 pages).

Latching and Holding With Bal Seal Canted-Coil Circular Welding Springs, Product News #164D, Nov. 23, 1991, Bal Seal Engineering Company, Inc., Santa Ana, California, U.S.A., (6 pages).

* cited by examiner

ELECTRICAL CONTACTS WITH ELECTRICALLY CONDUCTIVE SPRINGS

FIELD OF ART

The present disclosure generally relates to the field of electrical contacts and more specifically directed to face to face electrical contacts.

BACKGROUND

Face to face electrical contacts are used in numerous applications and industries, such as aerospace and automotive, to name a few. Requirements for this type of contacts may vary substantially depending on the application. However, it is a given that these contacts should provide reliable and robust electrical connection between the two faces.

SUMMARY

A face to face contact assembly comprising two faces and at least an inner electrically conductive spring element and at least an outer shielding spring element separated by a spacing element is provided. The inner and outer spring elements engaged with said spacing element and wherein the inner electrically conductive spring element electrically connects said two faces and the outer shielding spring element at least partially shields the electrical connection.

Another face to face contact assembly is provided comprising two faces and an inner electrically conductive spring element connecting said two faces.

Yet another face to face contact assembly is provided comprising two faces and at least two inner electrically conductive spring elements and at least an outer shielding spring element separated by a spacing element. The inner and outer spring elements engaged with said spacing element and wherein one of said inner electrically conductive spring elements is in electrical contact with one of said two faces, and another one of said inner electrically conductive spring elements is in electrical contact with the other one of said two faces, and the outer shielding spring element at least partially shields the electrical connection. The face to face contact assembly further wherein an inner electrically conductive component engages with said inner electrically conductive spring elements.

Aspects of the present disclosure include a face to face contact assembly comprising an electrically conductive spring element and a shielding spring element separated from one another by a spacing element and coaxially positioned relative to one another; said spacing element contacts both spring elements; wherein the electrically conductive spring element electrically connects two adjacent faces and the shielding spring element at least partially shields the electrical connection between the two faces provided by the electrically conductive spring element.

The face to face contact assembly wherein the spacing element can contact with at least one of the two faces.

The face to face contact assembly can further comprise a center support element contacting the electrically conductive spring element.

The face to face contact assembly wherein the spacing element can comprise an inner groove having one of a flat bottom, a V bottom and a C bottom receiving the electrically conductive spring element and an outer groove having one of a flat bottom, a V bottom and a C bottom receiving the shielding spring element.

The face to face contact assembly wherein the center support element can comprise an outer groove receiving the electrically conductive spring element, wherein said outer groove comprises one of a flat bottom, a V bottom and a C bottom.

The face to face contact assembly wherein the spacing element can be made of a dielectric material.

The face to face contact assembly wherein the center support element can be made of a dielectric material.

The face to face contact assembly wherein the spacing element can comprise more than one component.

The face to face contact assembly can further comprise a centering member protruding out of at least one of the two faces.

The face to face contact assembly wherein the spacing element can have an X-shape.

The face to face contact assembly wherein the spacing element can comprise inner and outer protrusions protruding into the electrically conductive spring element and the outer shielding spring element, respectively.

The face to face contact assembly can further comprise a first component in contact with a first side of the two spring elements and a second component in contact with a second side of the two spring elements.

A still further aspect of the present disclosure include a face to face contact assembly comprising two faces, and at least two inner electrically conductive spring elements and at least an outer shielding spring element separated by a spacing element; said inner and outer spring elements engaged with said spacing element; wherein one of said inner electrically conductive spring elements is in electrical contact with one of said two faces, and another one of said inner electrically conductive spring elements is in electrical contact with the other one of said two faces, and the outer shielding spring element at least partially shields the electrical connection provided by the at least two inner electrically conductive spring elements; wherein an inner electrically conductive component engages with said inner electrically conductive spring elements.

The face to face contact assembly wherein the spacing element can engage with at least one of the two faces.

The face to face contact assembly wherein the inner electrically conductive component can engage with at least one of the two faces.

The face to face contact assembly wherein the spacing element can comprise at least an inner groove having one of a flat bottom, a V bottom and a C bottom at least partially receiving one of the inner electrically conductive spring elements and an outer groove having one of a flat bottom, a V bottom and a C bottom at least partially receiving the outer shielding spring element.

The face to face contact assembly wherein the inner electrically conductive component can comprise at least an outer groove at least partially receiving at least one of the inner electrically conductive spring elements, wherein said outer groove comprises one of a flat bottom, a V bottom and a C bottom.

Yet another aspect of the present disclosure can include a face to face contact assembly comprising two faces, and at least two inner electrically conductive spring elements; wherein one of said inner electrically conductive spring elements is in electrical contact with one of said two faces, and another one of said inner electrically conductive spring elements is in electrical contact with the other one of said two faces; wherein an inner electrically conductive component engages with said inner electrically conductive spring elements.

The face to face contact assembly can further comprise a seal located externally of the shielding spring element.

A still yet additional feature of the present disclosure is a face to face contact assembly comprising: a spacer element comprising a first spacer element part separated from a second spacer element part by a band; an internal groove provided in the first spacer element part having a movable plate defining at least part of the internal groove; wherein the second spacer element comprises an interior block positioned inside a bore of an exterior block and defining an external groove therebetween; a spring provided in the external groove and forming a latching connection, a locking connection, or a holding connection between the interior block and the exterior block.

Yet other features of the present disclosure are as shown in each of the disclosed figures, in their individual forms, which take into account similar components from embodiment to embodiment in the written description that follows.

A still further aspect of the present disclosure is a method for making any one or any combination of the FTF contact assemblies disclosed herein.

A still further aspect of the present disclosure is a method for using any one or any combination of the FTF contact assemblies disclosed herein.

BRIEF DESCRIPTION OF THE DRAWINGS

These and other features and advantages of the present devices, systems, and methods will become appreciated as the same becomes better understood with reference to the specification, claims and appended drawings wherein:

DETAILED DESCRIPTION

The detailed description set forth below in connection with the appended drawings is intended as a description of the presently preferred embodiments of electrical contacts provided in accordance with aspects of the present devices, systems, and methods and is not intended to represent the only forms in which the present devices, systems, and methods may be constructed or utilized. The description sets forth the features and the steps for constructing and using the embodiments of the present devices, systems, and methods in connection with the illustrated embodiments. It is to be understood, however, that the same or equivalent functions and structures may be accomplished by different embodiments that are also intended to be encompassed within the spirit and scope of the present disclosure. As denoted elsewhere herein, like element numbers are intended to indicate like or similar elements or features.

In the following description, the term "Figure" is used interchangeably with its abbreviated term "FIG."

Figure 1:
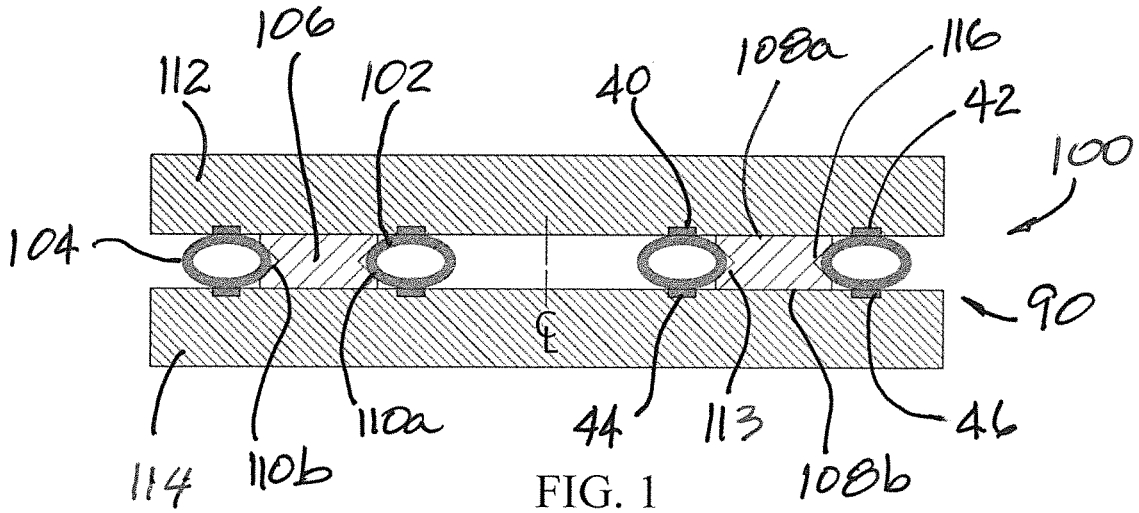
FIGS. 1, 1A, 1B, and 2 show face to face contact assemblies each comprising an electrically conductive spring element and a shielding spring element separated by a spacing element.

FIG. 1 shows a face to face ("FTF") contact assembly 100 comprising an inner electrically conductive spring element 102, which may also be referred to as a first spring element or first spring, and an outer shielding spring element 104, which may be referred to as a second spring element or second spring, separated from one another by a spacing or spacer element 106 made from an insulator material, such as a dielectric material. The second spring element 104 is made from a metallic material and therefore can also conduct electricity. In the present embodiment, the outer or second spring element is used to shield EM (electro-magnetic) waves. All three components 102, 104, 106 are annular in configuration and aligned about a centerline ℄. Thus, the inner spring 102, the outer spring 104, and the spacing or spacer element 106 are all understood to include an outer diameter and an inner diameter. The second spring element 104 is understood to have a larger OD (outside diameter) and ID (inside diameter) than the corresponding OD and ID of the first spring element 102. The second spring element 104 is also understood to have a larger OD and ID than the corresponding OD and ID of the spacing element 106. The second spring element and the first spring element are coaxially positioned relative to one another. The second spring element and the spacing element are also coaxially positioned relative to one another. Still further, an aspect of the present disclosure is understood to include an outer spring and an inner spring separated from one another by a spacing element. As shown, the outer spring 104, the inner spring 102, and the spacing element 106 are positioned generally along a same plane 90 and are coaxially disposed. Preferably, the three components are in contact with one another. Still preferably, the springs are canted coil springs, which may be axial canted coil springs and can cant along the axial direction of the centerline. In other examples, the springs are radial canted coil springs and are configured to cant along a radial direction of the centerline.

The spacing element 106 has a first face 108*a* with a first surface, a second face 108*b* with a second surface, and two sidewalls 110*a*, 110*b* and wherein the electrically conductive spring element or the first spring 102 is positioned along the ID of the spacing element. The spacing element 106 is made from a dielectric material and electrically isolates the first spring 102 from the second spring 104. Although the spacing element 106 is symmetrical along at least two planes, the spacing element can be non-symmetrical. Further, the spacer element 106 may be made from more than one components and wherein not all of the components must be dielectric. For example, a section of the spacing element 106 of the multi-component embodiment closer to the second spring 104 may be made from a conductive material with the remaining components or structures of the spacing element closer to the first spring 102 being non-conducting so as to electrically isolate the first spring from the second spring. In another embodiment, a dielectric section is provided elsewhere so long as a clear insulator layer is provided between the first spring and the second spring.

Shown in contact with the first spring 102 and the second spring 104 are two planar components, which may be referred to as a first structure or component 112 and a second structure or component 114. The two components 112, 114 can be placed in electrical communication with one another through the inner spring 102 or through both the inner spring 102 and the outer spring 104. For the latter situation involving both springs, each of the two components 112, 114 incorporate isolation means, such as a seal, a dielectric layer or the like, to isolate the contact points with the two springs 102, 104. The two components 112, 114 can represent any number of electrical devices, such as printed circuit boards (PCB), printed wiring boards (PWB), surface mounted devices, or two leads from two different nodes or circuit boards or a power source, to name a few. As shown, the first component 112 has a first trace or lead 40 and a second trace or lead 42 that contact with a corresponding first lead or trace 44 and second trace or lead 46 on the second component 114.

The shielding spring element or the second spring 104 is configured to at least partially shield the electrical connection provided by the electrically conductive spring element 102. For example, the second or outer spring 104 is configured to shield EM waves or signals produced by the first or inner spring element 102 from reaching or interfering with surrounding components or devices. The second spring 104 is also configured to shield the inner spring 102 from EM waves or signals from outside environment so that they do not interfere with the signal transferred through the contact assembly 100. In an example, both the electrically conductive and the shielding spring elements 102, 104 are canted coil springs, which can be either axially canted coil springs or radially canted coil springs as those terms are understood in the art. However, other spring elements may be used, such as, for example, V-springs, ribbon springs, compression springs, Belleville springs, wavy springs, etc. The spacing element 106 illustrated in FIG. 1 comprises an inner V-bottom groove 113 and an outer V-bottom groove 116, which can optionally include a flat bottom between the two tapered surfaces, i.e., a truncated V. However, other groove bottom shapes may be used, such as, for example, a flat bottom, a C-bottom, etc. Moreover, the sidewalls 110*a*, 110*b* may be flat, i.e., have no grooves, such as shown for the spacing element 122 of the assembly 120 of FIG. 1A. Still alternatively, the spacing element 106 may have different inner and outer groove shapes. For example, one groove is a V-groove while the other groove is a generally square shape or has a C-bottom. FIG. 1B is a perspective view of the cross-sectional view of FIG. 1A, which shows two shielding springs 102, 104 separated from one another by a spacing element 122 and wherein one spring is located radially inward of the other and both shielding springs are in an annular configuration.

Thus, an aspect of the present disclosure is understood to include a face to face contact assembly comprising a first spring, a spacing or spacer element, and a second spring that are located or positioned generally along a same plane. In one example, the components are annular in configuration and are co-axially positioned with the second spring located externally of the first spring. The spacing element 106 is in contact with both the first spring 102 and the second spring 104 and wherein the second spring 104 is a shielding spring for shielding EM waves generated by the first spring or EM waves or signals from the environment from interfering with the first spring 102. The spacer element 106 comprises both inner and outer sidewalls and in contact with the first and second springs with its inner and outer sidewalls, respectively.

Figure 1A:
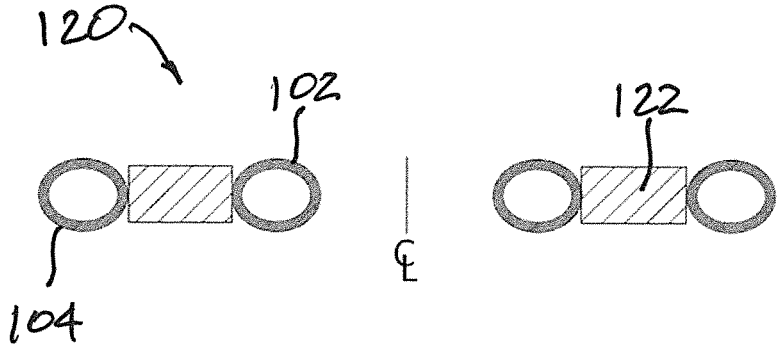
Figure 1B:
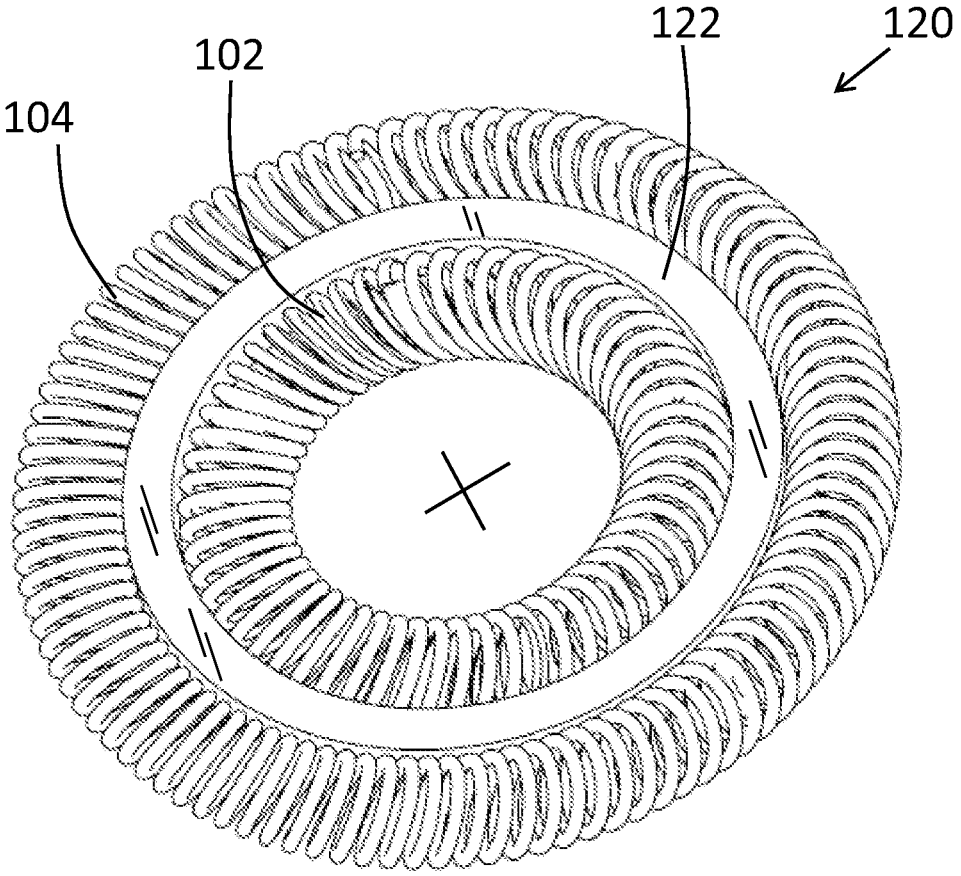

In some examples, an environmental sealing means may be added to the connector 100 of FIGS. 1 and 1A. For example, an O-ring or a spring-energized seal, such as those disclosed in U.S. Pat. No. 5,979,904 to Balsells, may be added around the outermost circumference to seal the connector.

For other FTF contact assemblies and assembly components disclosed herein below, such as for other support and spacer components, it is understood that where a feature is shown but not expressly described and is otherwise the same or similar to the feature or features described elsewhere, such as above with reference to FIGS. 1 and 1A, the disclosed part or parts shown in the subsequent drawing figures but not expressly described because of redundancy and because knowledge is built on a foundation laid by earlier disclosures may nonetheless be understood to be described or taught by the same or similar features expressly set forth in the text for the embodiments in which the feature or features are described, such as for the contact assemblies of FIGS. 1 and 1A. Said differently, subsequent disclosures of the present application are built upon the foundation of earlier disclosures unless the context indicates otherwise. The disclosure is therefore understood to teach a person of ordinary skill in the art the disclosed embodiments and the features of the disclosed embodiments without having to repeat similar components and features in all embodiments since a skilled artisan would not disregard similar structural features having just read about them in several preceding paragraphs nor ignore knowledge gained from earlier descriptions set forth in the same specification. As such, the same or similar features shown in the following contact assemblies incorporate the teachings of earlier embodiments unless the context indicates otherwise. Therefore, it is contemplated that later disclosed embodiments enjoy the benefit of earlier expressly described embodiments, such as features and structures of earlier described embodiments, unless the context indicates otherwise. For example, while some later connector embodiments are not shown positioned between two components 112, 114, such as that shown in FIG. 1, they are understood to be usable as such based on the discussions of FIG. 1.

Figure 2:
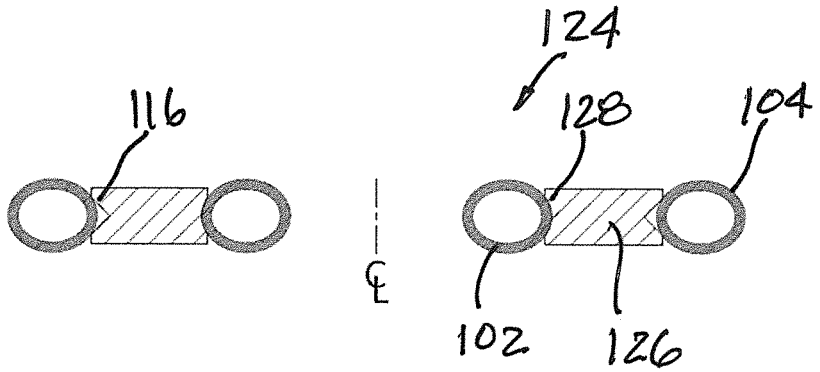

FIG. 2 shows a face to face contact assembly 124 similar to that presented in FIG. 1, but with the spacing element 126 having an inner C bottom groove 128 and an outer V-groove 116. The assemblies 120, 124 of FIGS. 1A and 2 are both understood to each be connectable to one or two adjacent components 112, 114, similar to that shown in FIG. 1. Thus, an aspect of the present disclosure is a spacer element having different sidewall geometries for contacting or supporting adjacent canted coil springs. Said spacer element may be used not only with the assembly of FIG. 2 but with other contact assemblies described herein.

Figure 3:
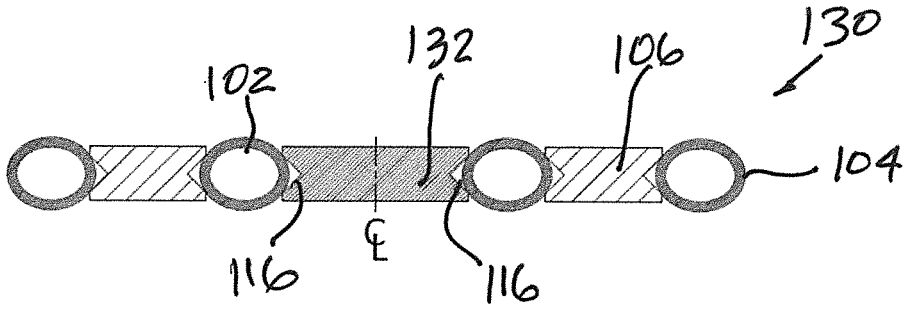
FIG. 3 shows a face to face contact assembly similar to those shown in FIGS. 1, 1A and 2, further comprising a center support element.

FIG. 3 shows a face to face contact assembly 130 similar to those shown in FIGS. 1, 1A, and 2, and comprises a spacer element 106 located between the first spring element 102 and the second spring element 104. In the present embodiment, the assembly 130 further comprises a center support element 132 that receives the inner electrically conductive spring element 102. The center support element 132 illustrated in the present embodiment comprises a V-bottom groove 116 along its side receiving the inner electrically conductive spring element 102. However, other groove bottom shapes may be used, such as, for example, flat bottom, C bottom, etc. Moreover, no grooves may be used, i.e., flat sidewalls. In one example, the center support element 132 may comprise a structure to support the assembly 130 inside a housing (not shown). The FTF contact assembly 130 of the present embodiment is usable as with the assembly of FIG. 1. The center support element 132 should be non-conducting.

Figure 4:
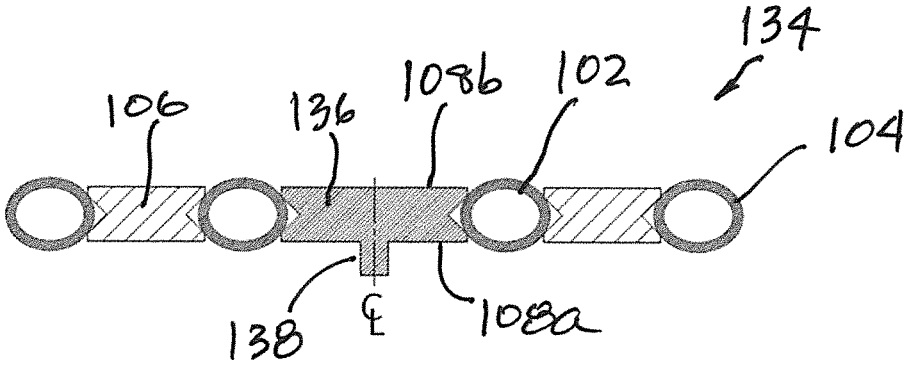
FIG. 4 shows a face to face contact assembly similar to those shown in FIGS. 1, 1A and 2, further comprising a center support element with an engaging component.

FIG. 4 shows a face to face contact assembly 134 similar to that shown in FIG. 3 wherein a center support element 136 is provided having an engaging component 138 extending from one or both faces 108*a*, 108*b* of the support element. The engaging component 138 may embody a stem or a post with or without surface features, such as projections or detents, for use in conjunction or in connection with one of the two adjacent components 112, 114 (FIG. 1). For example, the engaging component 138 may comprise a stem with a positioning feature or a mechanical connector to connect the assembly 134 to a housing or to connect the various components together. The engaging component 138 may comprise additional features or structures not shown in FIG. 4 to achieve its purpose, such as set screws, detents, threaded bores, flanges, spring groove, etc. Moreover, the center support element 136 may comprise more than one engaging components or features.

Figure 4A:
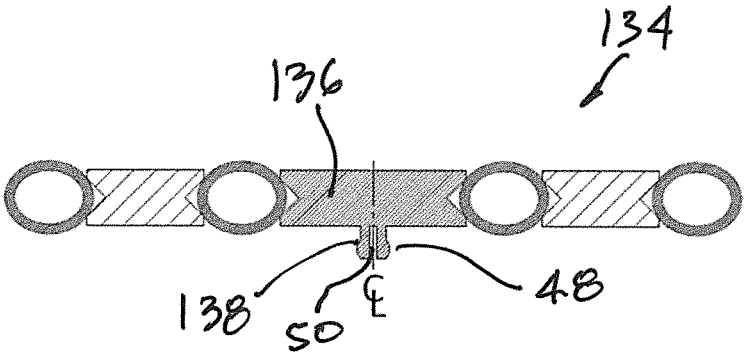
FIG. 4A is similar to the contact assembly of FIG. 4 wherein the engaging component has further surface feature for engaging.

FIG. 4A shows an alternative FTF contact assembly 134 similar to that of FIG. 4 and includes a center support element 136. In the present embodiment, the center support element 136 comprises a stem comprising an enlarged lip 48 and a channel 50 formed through at least part of the stem. The enlarged lip 48 can engage a female detent and the channel is provided to allow inward deflection of the enlarged lip 48 as it passes through the female detent.

Figure 4B:
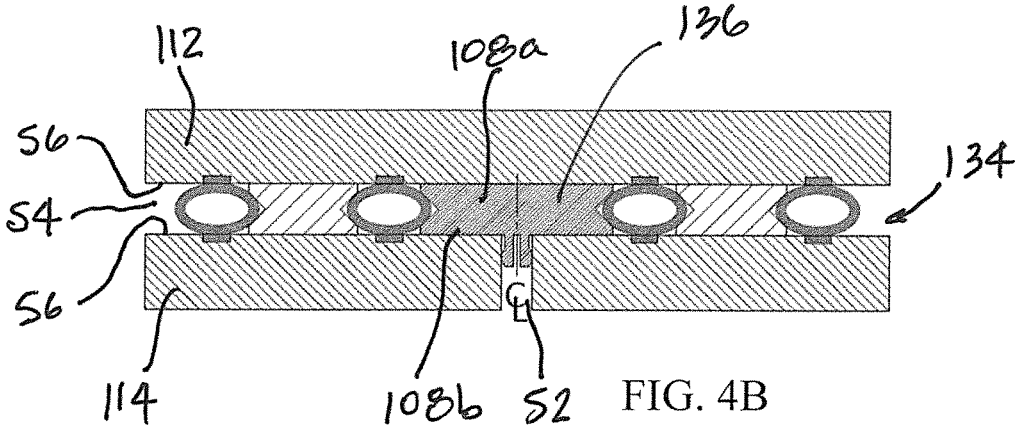
FIG. 4B shows the contact assembly of FIG. 4A in contact with a first component and a second component.

FIG. 4B shows the FTF contact assembly 134 of FIG. 4A located between a first component 112 and a second component 114, similar to the contact assembly 100 of FIG. 1. As shown, the engaging component 138 projects into a bore 52 of the second component 114 to mechanically retain the connect assembly 134 to the second component. Optionally, the center support element 136 can incorporate a second engaging component extending out of the first surface 108*a* as well as the second surface 108*b* to engage a bore formed in the first component 112.

As previously alluded to, an environmental seal, such an O-ring or a spring energized lip seal, may be provided to seal the contact assembly 134. For example, the environmental seal may seal the gap 54 located between the first and second components 112, 114. For example, the seal can seal against the interior surfaces 56 of the first and second components 112, 114 to keep moisture, dust, and other unwanted items from entering the contact assembly 134.

Figure 5:
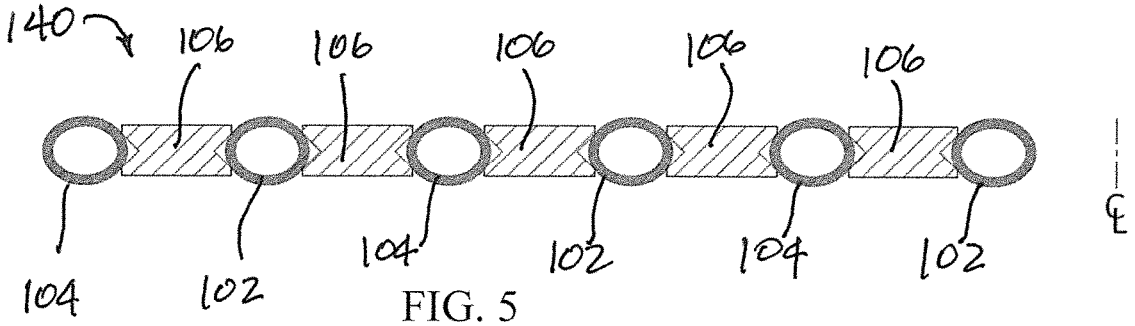
FIG. 5 shows a face to face contact assembly comprising electrically conductive spring elements alternating with shielding spring elements separated from each other by spacing elements.

FIG. 5 shows a face to face contact assembly 140 comprising a plurality of electrically conductive spring elements 102 alternating with shielding spring elements 104 and separated from each other by spacing elements 106. The spacing elements 106 illustrated in the present embodiment comprise an inner and an outer V-bottom groove receiving corresponding spring elements. However, other groove bottom shapes may be used, such as, for example, flat bottom, C bottom, etc. Moreover, no grooves may be used, such as using a flat sidewall. As shown, two conductive spring elements 102 are positioned internally of a single shielding spring element 104. In another example, the inner-most and the outer-most spring elements are shielding spring elements 104 while the middle spring is a conductive spring element 102, meaning electric signals or waves are configured to pass through the conductive spring element 102. For each spacer element 106, at least part of the structure must be non-conducting to isolate two adjacent springs.

Figure 5A:
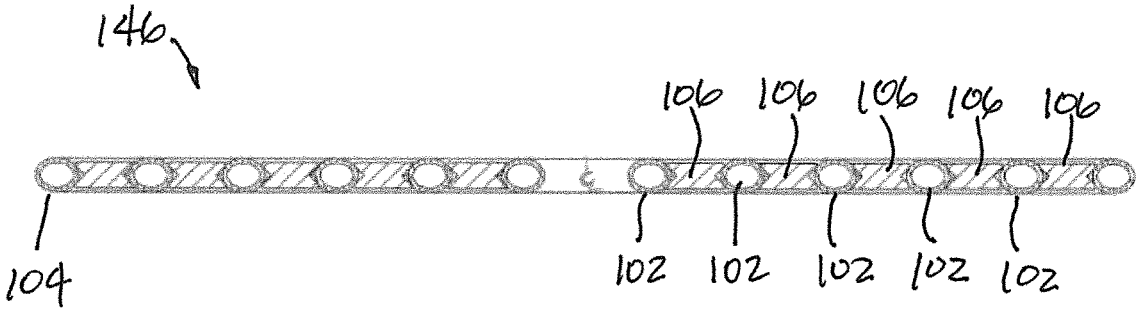
FIG. 5A shows a face to face contact assembly comprising multiple electrically conductive spring elements and an outer shielding spring element separated from each other by spacing elements.

FIG. 5A shows a face to face contact assembly 146 comprising multiple inner electrically conductive spring elements 102 and an outer shielding spring element 104 separated from each other by spacing elements 106. The spacing elements 106 illustrated in this figure comprise an inner and an outer V-bottom groove receiving corresponding spring elements. However, other groove bottom shapes may be used, such as, for example, flat bottom, C bottom, etc. Moreover, no grooves may be used, such as that shown in FIG. 1A. In the present embodiment, there are five inner electrically conductive spring elements 102 and one outer shielding spring element 104. In other examples, the number of inner electrically conductive and shielding spring elements 102, 104 may vary depending on the requirements of the applications where the face to face contact assembly 146 may be used.

Figure 6:
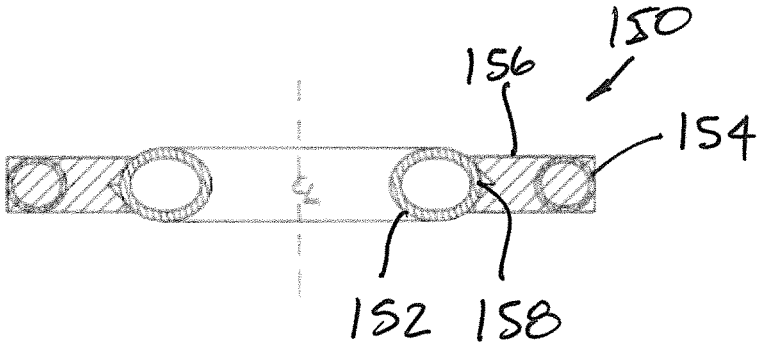
FIG. 6 shows a face to face contact assembly comprising an inner electrically conductive spring element and an outer shielding spring element separated by a spacing element, wherein the outer shielding spring element is embedded into the spacing element.

FIG. 6 shows a face to face contact assembly 150 comprising an inner electrically conductive spring element 152 and an outer shielding spring element 154 separated by a spacing element 156, wherein the outer shielding spring element 154 is embedded into the spacing element 156. The location of the embedded outer shielding spring element relative to the spacing element may vary from that shown. The spacing element 156 illustrated in the present embodiment comprises a V-bottom groove 158 receiving the inner electrically conductive spring element 152. However, other groove bottom shapes may be used, such as, for example, flat bottom, C bottom, etc. Moreover, no grooves may be used. In other examples, the shielding spring element 154 is not embedded into the spacing element 156 but is instead embedded into an elastomeric outer jacket, such as an O-ring, and positioned against an outer groove on the spacing element 156. The center of the spring may be hollow or filled with an elastomeric material. In another embodiment, the outer spring is formed around an elastomeric material with the coils exposed on the outside.

Figure 6A:
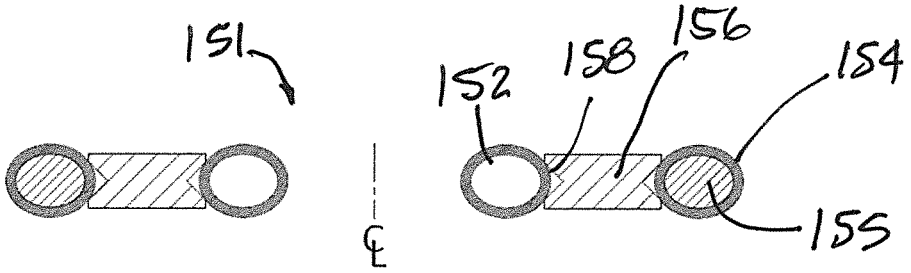
FIG. 6A shows a face to face contact assembly comprising an inner electrically conductive spring element and an outer shielding spring element separated by a spacing element, wherein the outer shielding spring element is filled with an elastomeric material.

FIG. 6A shows a face to face contact assembly 151 comprising an inner electrically conductive spring element 152 and an outer shielding spring element 154 separated by a spacing element 156, wherein the outer shielding spring element 154 is filled with elastomeric material 155. The spring element 154 has a combination of properties of a canted coil spring and the elastomeric material. The spacing element 156 illustrated in the present embodiment comprises a V-bottom groove 158 on two sidewalls receiving the inner electrically conductive spring element 152 and the outer shielding spring element 154. However, other groove bottom shapes may be used, such as, for example, flat bottom, C bottom, etc. Moreover, no grooves may be used. In other examples, the shielding spring element 154 is not embedded into the spacing element 156 but is instead embedded into an elastomeric outer jacket, such as an O-ring, and positioned against an outer groove on the spacing element 156. The center of the spring may be hollow or filled with an elastomeric material. In another embodiment, the outer spring is formed around an elastomeric material with the coils exposed on the outside.

Figure 6B:
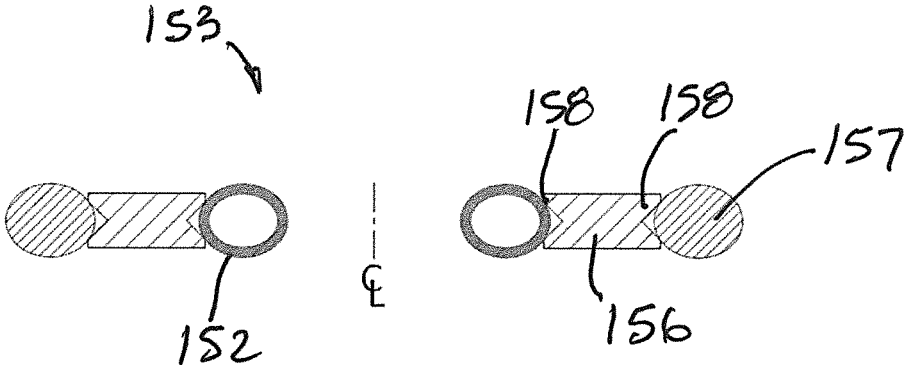
FIG. 6B shows a face to face contact assembly comprising an inner electrically conductive spring element and an outer shielding element separated by a spacing element, wherein the outer shielding element is a shielding gasket.

FIG. 6B shows a face to face contact assembly 153 comprising an inner electrically conductive spring element 152 and an outer EMI shielding gasket 157 separated by a spacing element 156. In one example, the EMI shielding gasket 157 is electrically conductive. For example, a wire or a wire cage may be filled with or formed with an elastomeric material so that the gasket is electrically conducting. The spacing element 156 illustrated in the present embodiment comprises a V-bottom groove 158 on two sidewalls receiving the inner electrically conductive spring element 152 and the outer shielding spring element 154. However, other groove bottom shapes may be used, such as, for example, flat bottom, C bottom, etc. Moreover, no grooves may be used.

Figure 7:
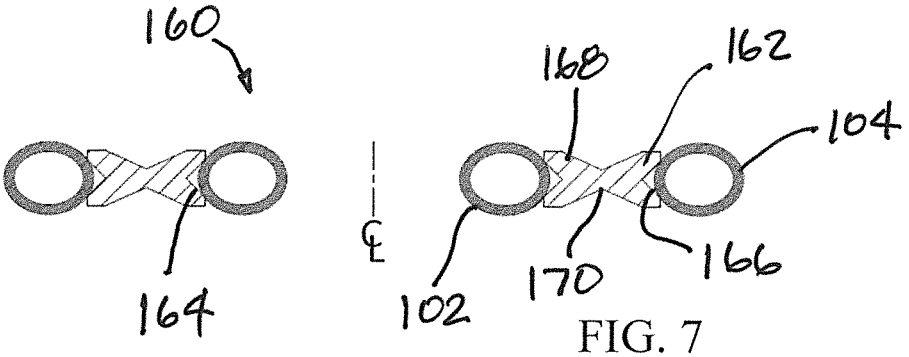
FIG. 7 shows a face to face contact assembly similar to those in FIGS. 1 and 2, wherein the spacing element has an X-shape.

FIG. 7 shows a face to face contact assembly 160 similar to those in FIGS. 1 and 2, wherein the spacing element 162 has a non-rectilinear cross-sectional shape, such as having an X-shape. The spacer 162 may be flexible, such as made from an elastomeric material or a thermoplastic elastomer (TPE), or relatively rigid material. For example, the spacer 162 may be molded from a thermoplastic material. Such shape provides the spacing element with more flexibility along its central axis and thus allows for accommodating larger tolerances regarding the spacing between the two faces. Other shapes for providing increased flexibility along the central axis of the spacing element are also contemplated. The spacing element 162 of FIG. 7 has an inner groove 164 and an outer groove 166, which can both be V-bottom grooves or other groove types discussed elsewhere herein. The spacing element 162 also has an upper groove 168 and a lower groove 170.

Figure 8:
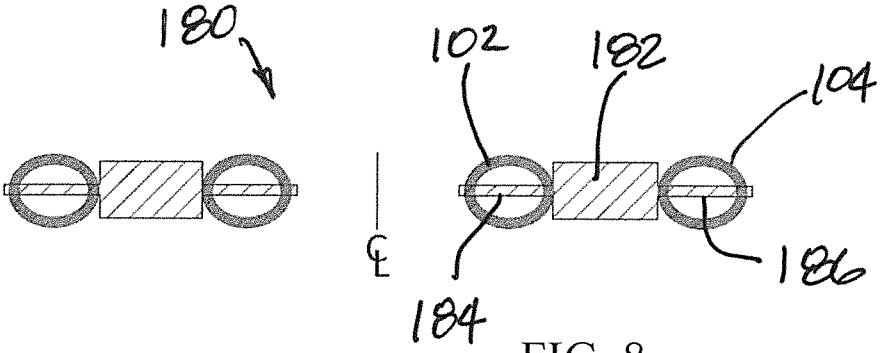
FIG. 8 shows a face to face contact assembly similar to those in FIGS. 1 and 2, wherein the spacing element comprises inner and outer protrusions protruding into the inner electrically conductive and outer shielding spring elements, respectively.

FIG. 8 shows a face to face contact assembly 180 similar to those in FIGS. 1 and 2, wherein the spacing element 182 comprises inner protrusion 184 and an outer protrusion 186 protruding into the inner electrically conductive spring element 102 and the outer shielding spring element 104, respectively. In the present embodiment, the protrusions 184, 186 protrude through the entire width of both the inner electrically conductive spring and the outer shielding spring elements 102, 104. However, the protrusions may protrude into the spring elements covering only a portion of their width. The protrusions 184, 186 provide support to the spring elements and can help keep the spring elements together with the spacing element 182 to prevent unwanted separation, such as during installation, assembly, or maintenance. For example, the protrusions 184, 186 can project through gaps or spaces between adjacent spring coils. In some examples, more than two inner protrusions and more than two outer protrusions are provided on the spacing element 182.

Figure 9:
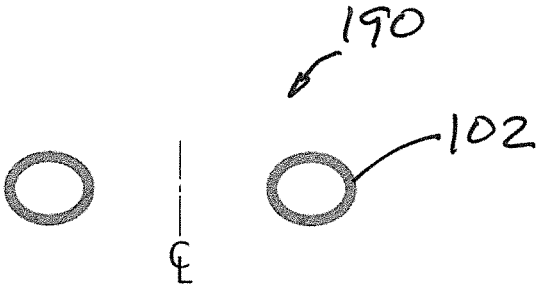
FIG. 9 shows a face to face contact assembly consisting of an inner electrically conductive spring element.

FIG. 9 shows a face to face contact assembly 190 essentially consisting of an electrically conductive spring element 102 only. Optionally a center support element (not shown) may be included. In the present embodiment, the electrically conductive spring element 102 consists of a canted coil spring. The spring element 102 may be useable as a first spring, similar to that shown in FIGS. 1 and 2 and elsewhere herein. In other examples, the electrically conductive spring element 102 may be other spring types, such as, for example, V-springs, ribbon springs, compression springs, Belleville springs, wavy springs, etc. Canted coil springs usable herein are disclosed in U.S. Pat. No. 4,655,462, the contents of which are expressly incorporated herein by reference as if set forth in full. Further, the wires for forming the springs may be coated with one or two other metallic materials or layers to control various characteristics of the springs, such as to increase the resistivity of the springs.

Figure 10:
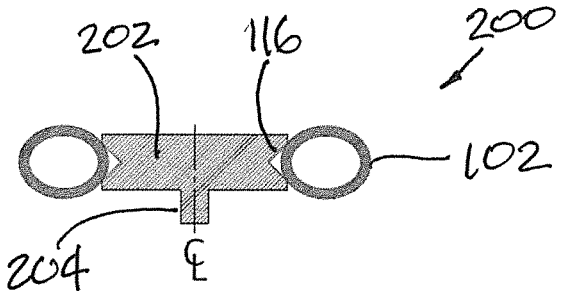
FIG. 10 shows a face to face contact assembly similar to that shown in FIG. 9 further comprising a center support element with an engaging component.

FIG. 10 shows a face to face contact assembly 200 similar to that shown in FIG. 9 further comprising a center support element 202 with an engaging component 204 configure to engage an adjacent component, similar to component 112 or 114 of FIG. 1. The center support element 202 illustrated in FIG. 10 comprises a V-bottom groove 116 receiving the electrically conductive spring element 102. However, other groove bottom shapes may be used, such as, for example, flat bottom, C bottom, etc. Moreover, no grooves may be used. The engaging component 204 illustrated in the present embodiment has the form of a pin. However, it may have a different shape. Furthermore, the center support element 202 may be engaged with at least one face component, such as one adjacent PCB, without having such engaging component 204. Moreover, it may have more than one engaging components, such as two or more. Additionally, the center support element 202 may protrude from one or two adjacent components, such as one or two adjacent PCBs.

Figure 11:
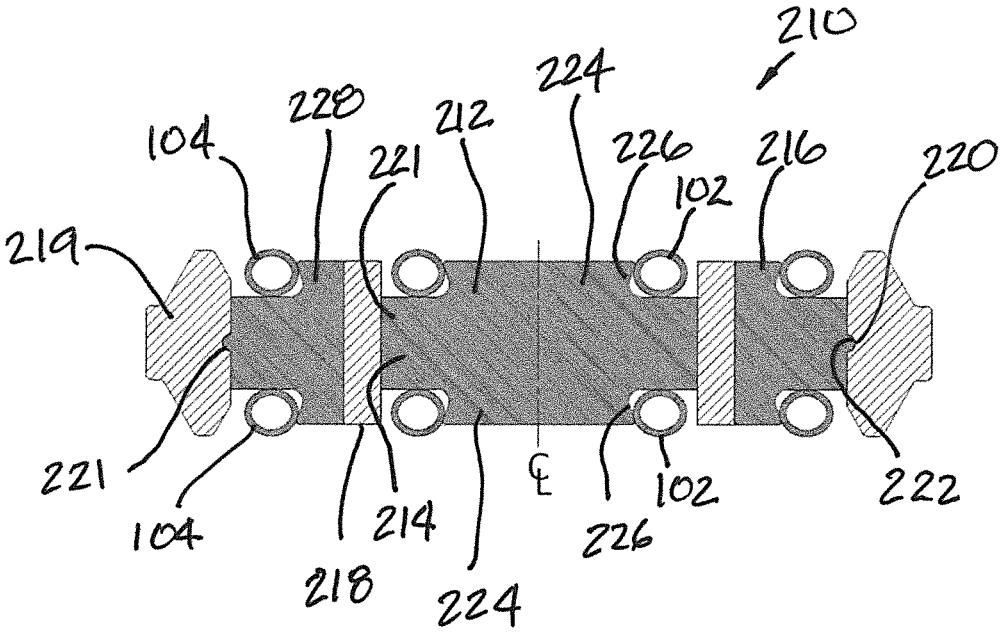
FIG. 11 shows a face to face contact assembly comprising two faces or layers, two inner electrically conductive spring elements, and two outer shielding spring elements.

FIG. 11 shows a face to face contact assembly 210 comprising a stack of two electrically conductive spring elements 102 and a stack of two shielding spring elements 104 separated by a spacing element 212, which may be unitarily formed. In the present embodiment, the spacing element 212 is further provided as a first spacing element part 214 and a second spacing element part 216, separated from one another by a band 218. An outer retaining band 219 is provided to retain the various components together. In one example, the outer retaining band 219 is provided with an annular groove 220 for receiving a tongue 222 on the second spacing element part 216. The retaining band 219 may be formed from a non-conductive material. The retaining band can serve to retain the various components and/or to provide environmental sealing.

In one example, the face to face contact assembly 210 is provided with an electrically conductive center support element 224 projecting from the central body 221 and having straight or tapered sidewalls 226 and receiving the inner electrically conductive spring elements 102 and enabling an adequate stacking of the same. The second spacing element part 216 is also provided with a center support element 228 projecting from a central body 221. In the embodiment shown, the internal band 218 is made from an isolating material, such as a dielectric material. In other examples, the central body 221 is made from a conducting material while the center support elements 224, 228 and the band 218 from a non-conducting material. Generally, a conductive path must be provided between each respective layer pairs of springs while two adjacent pairs are isolated to avoid interference.

The springs 102, 104 are shown with similar sized coils. In other examples, the coils have different sizes, such as by incorporating different central body 221 thicknesses to allow for the use of different coil sizes. The double layer contact assembly 210 of FIG. 11 allows the operating working range of the canted coil springs to increase over a single layer contact assembly, such as the single layer contact assembly of FIG. 1. This allows for more flexibility in terms of warp, manufacturing tolerance, and alignment.

Figure 12:
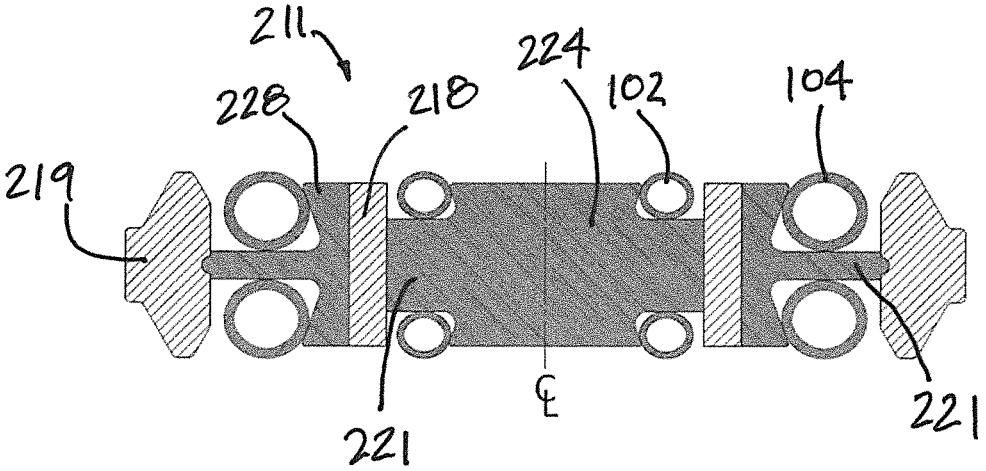
FIG. 12 a face to face contact assembly comprising two faces or layers, two inner electrically conductive spring elements, and two outer shielding spring elements, similar to FIG. 11 and wherein different dimensions are used enable the use of different spring coil sizes.

FIG. 12 shows a face to face contact assembly 211 comprising a stack of two electrically conductive spring elements 102 and a stack of two shielding spring elements 104 separated by a spacing element 212, which may be unitarily formed. The present contact assembly 211 is similar to the contact assembly of FIG. 11 except wherein the central body 221 of the spacer element 212 has a different thickness than the central body 221 of the center support element 218. As shown, the central body 221 of the spacer element 212 is thicker than the central body 221 of the center support element 228. This allows for different spring coil sizes to be used. As shown, the conductive spring elements 102 have smaller coil sizes than the coils of the shielding spring elements 104. In another example, the reverse is provided with the coils of the conductive spring elements 102 being larger.

Figure 13:
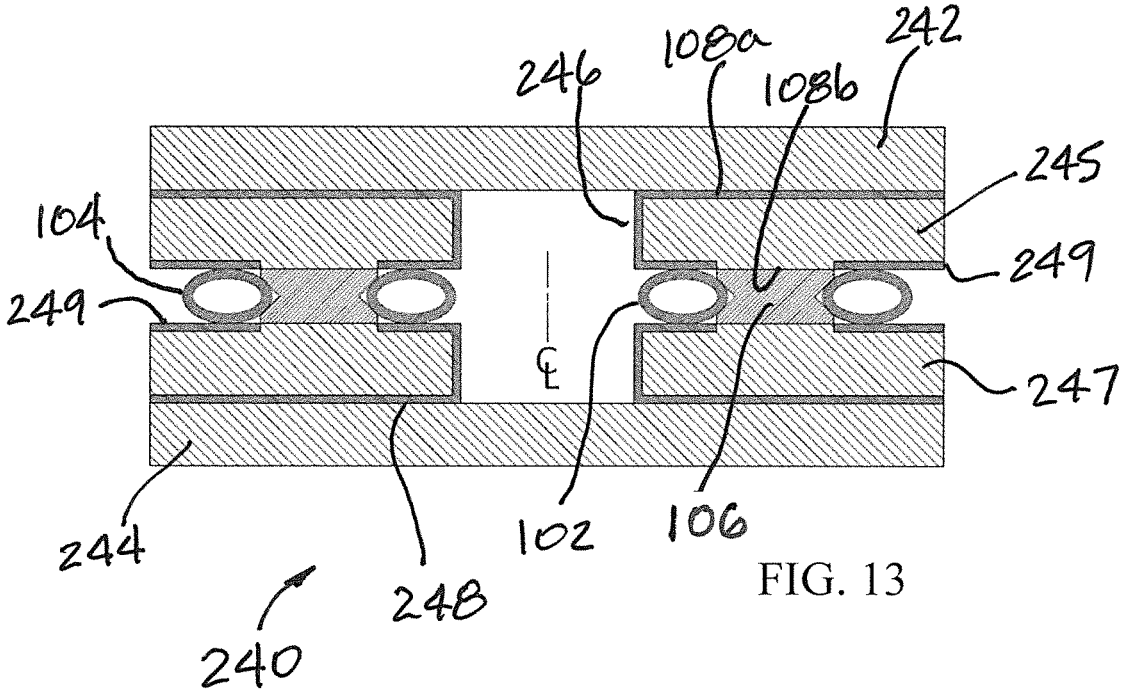
FIG. 13 shows a face to face contact assembly similar to that described in FIG. 1, electrically connecting two adjacent components.

FIG. 13 shows a face to face contact assembly 240 comprising an electrically conductive spring element 102 and a shielding spring element 104 separated by a spacing or spacer element 106, wherein the inner and outer spring elements are in contact with two printed circuit boards 242, 244. The inner spring element 102 contacts an electrical terminal 246 located on the upper PCB 242 and an electrical terminal 248 located on the lower PCB 244. Thus, the face to face contact assembly 240 is understood to electrically connect two adjacent printed circuit boards 242, 244 via the electrical terminals 246, 248 and the conductive spring element 102. Note that the terms first, second, upper, lower, inner, and outer used elsewhere herein merely serve to distinguish different reference points for discussion purposes only but do not necessarily structurally limit the components unless the context indicates otherwise.

In an example, inner and outer coupling elements 245, 247 are provided each with a bore, an upper surface 108*a* and a lower surface 108*b*. Each coupling element 245/247 is provided with an electrical terminal 246, 247. As shown, the terminal on each coupling element extends continuously between the upper and lower surfaces 108*a*, 108*b*. Also shown are conductive plates 249 provided on the lower surfaces 108*b* of the coupling elements 245, 247. The shielding spring element 104 is biased against the plates 249. In other examples, the shielding spring element 104 is filled with an elastomeric material, such as that shown with reference to FIG. 6A, or is replaced with a shielding gasket, such as that shown in FIG. 6B.

Figure 14:
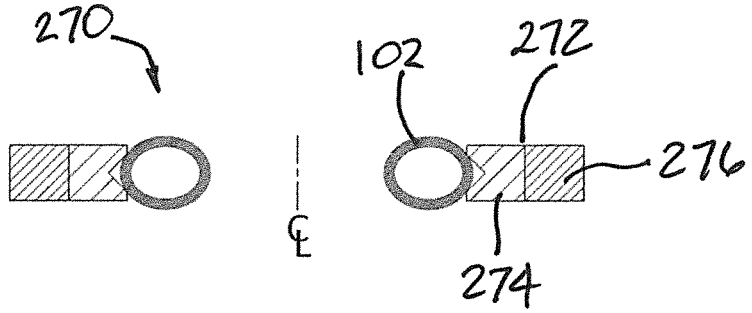
FIG. 14 shows a face to face contact assembly comprising an inner electrically conductive spring element and a compound element, which acts as both a spacer and a shielding element.

FIG. 14 shows a face to face contact assembly 270 comprising a conductive spring element 102 positioned adjacent a compound element 272, which acts as both a spacer and a shielding element. In an example, the compound element comprises an inner section 274 made of a first material and an outer section 276 made of a second material. One of the first and second materials shields electromagnetic radiation generated by the electrically conductive spring element 102 and may consist of the other one of the first and second materials filled with particles that confer such shielding capability. The inner and outer sections 274, 276 may be unitarily formed, such as by co-molding or over-molding. Additionally, the compound component 272 may comprise more than two sections. In the alternative embodiment with more than two sections, more than one of the pluralities of sections may provide electromagnetic shielding. As shown, the inner section 274 may be made from an elastomer, a TPE, or a thermoplastic material while the outer section 276 of the compound element 272 may include a conductive cage filled with the same or different non-conductive material as the inner section 274.

Figure 15:
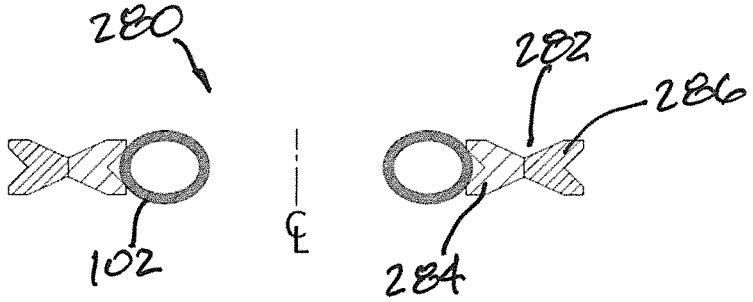
FIG. 15 shows a face to face contact assembly comprising an inner electrically conductive spring element and a compound element, which acts as both a spacer and a shielding element, and wherein the shape of the compound element is generally an X-shape.

FIG. 15 shows a face to face contact assembly 280 comprising a conductive spring element 102 positioned adjacent a compound element 282, which acts as both a spacer and a shielding element. In an example, the compound element 282 comprises an inner section 284 made of a first material and an outer section 286 made of a second material, similar to that of FIG. 14 but wherein the contour is generally shaped as an "X."

Figure 16:
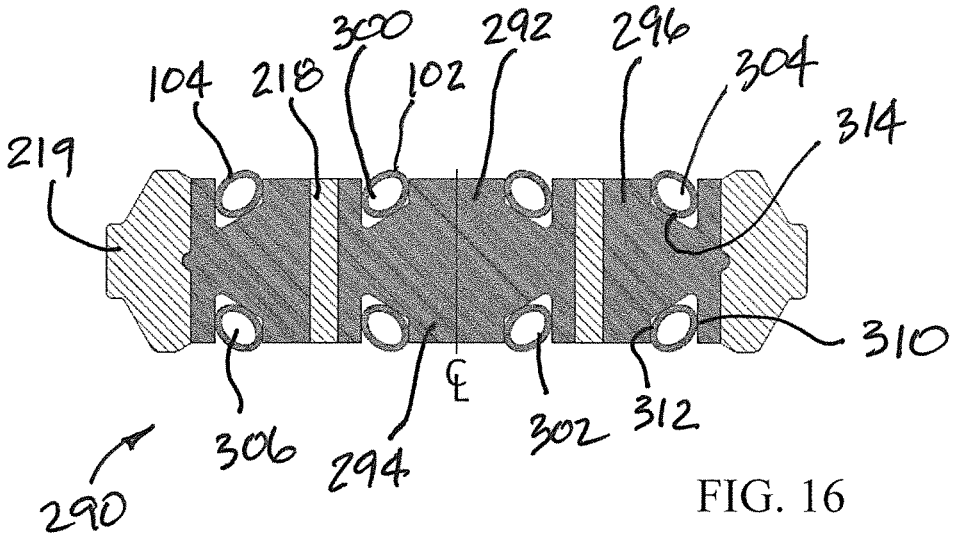
FIG. 16 shows a two-layer face to face contact assembly similar to FIGS. 11 and 12 and wherein the grooves have tapered surfaces to rotate the springs positioned therein.

FIG. 16 shows yet another FTF contact assembly 290 provided in accordance with aspects of the present disclosure. The present contact assembly is similar to the contact assembly of FIGS. 11 and 12 with a few exceptions. In the present embodiment, the contact assembly 290 also incorporates a spacer element 292 and a retaining band 219 and is located between two electrical components 242, 244 located at the two faces of the spacer element 292. The two electrical components 242, 244 can be similar the electrical components 112, 114 shown in FIGS. 1 and 4B or the electrical components 242, 244 shown in FIG. 13. In the present embodiment, the spacer element 292 comprises a first spacer element part 294 and a second spacer element part 296 with a band 218 located therebetween. The first spacer element part 294 incorporates an upper groove 300 and a lower groove 302 for accommodating an upper conductive spring element 102 and a lower conductive spring element 102. Similarly, the second spacer element part 296 incorporates an upper groove 304 and a lower groove 306 for accommodating an upper shielding spring element 104 and a lower shielding spring element 104, which shielding spring elements 104 are located radially outwardly of the conductive spring elements 102 when viewed with reference to the centerline ℄ of the face to face contact assembly 290. The radially outward position of the shielding spring element 104 relative to the conductive spring element 102 along one layer of the contact assembly resembles that of FIG. 1B. Each respective shielding spring element 104 can be called a shielding component. In one example, the four grooves 300, 302, 304, 306 have the same general configuration. In other examples, the grooves have different groove configurations or geometries. For example, the upper grooves 300, 304 can have the same shape while the lower grooves 302, 306 can have different shapes than the upper grooves. In another example, the upper and lower grooves 300, 302 of the first spacer element part 294 are the same and the upper and lower grooves 304, 306 of the second spacer element part 296 are the same but the two pairs of grooves differ from one another. By differ or different, the grooves can have different geometries to force the springs that sit in the respective grooves to turn at a different turning angle or to not turn at all, as further discussed below.

As shown, each of the four grooves comprises two sidewalls 310, 312 and a bottom wall 314 located therebetween. The bottom wall 314 is tapered so that each groove has one sidewall 310 that is longer than the other sidewall 312 of the same groove. Each groove also has a groove width measured between the two sidewalls. In the example shown, the groove width is narrower than the major axis of the spring coils of the respective spring so that the coils of the spring are forced to rotate when placed inside the groove as shown. Of course, it is well known that each coil of a spring coil has a major axis and a minor axis and wherein the major axis is the longer of the two axes. The grooves can be sized with a desired width and a desired angle for the tapered bottom wall 314 to force the spring major axis to rotate and be at a desired turning angle when positioned inside the groove, for example, anywhere between about 5 degrees to about 85 degrees with zero degree shown corresponding to the springs shown in FIGS. 11 and 12. Thus, the contact assembly 290, by incorporating grooves that can force the springs located therein to turn, may accommodate either radial canted coil springs or axial canted coil springs. Further, by sizing the turning angle of the coils to a desired angle, the loading forces to cant the coils when placed in contact with adjacent components, such as PCBs, can be controlled. For example, the forces can increase if the contacts are closer to the major axis, as shown, and can be made to lower if the contacts are closer to the minor axis, as shown in FIGS. 11 and 12. The spring properties can also be controlled to increase or decrease the loading forces on the adjacent components.

Figure 17:
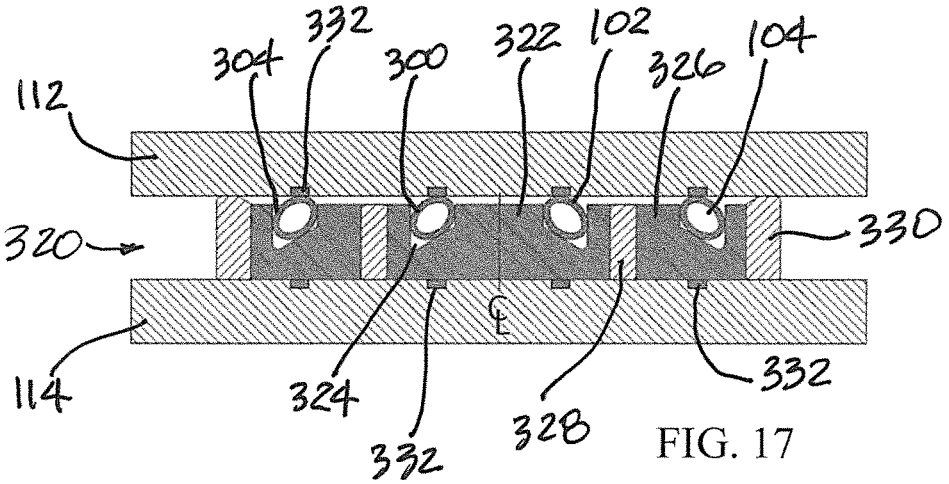
FIG. 17 shows a face to face contact assembly similar to that of FIG. 16, but as a single layer contact assembly with grooves having tapered surfaces.

With reference now to FIG. 17, a schematic sectional view of a FTF contact assembly 320 provided in accordance with further aspects of the present disclosure is shown. The present contact assembly 320 is similar to the contact assembly of FIG. 16 with a few exceptions. Firstly, the present contact assembly has a single layer of springs 102, 104 as opposed to a double layer of springs shown in FIG. 16. The present assembly 320 has a spacer element 322 comprising a first spacer element part 324 separated from a second spacer element part 326 by a band 328, and a retainer band 330, similar to that of FIG. 16 except for being a single layer. The present connector also has a groove 300 formed with the first spacer element part 324 for accommodating the conductive first spring 102 and a groove 304 formed with the second spacer element part 326 for accommodating the second shielding spring 104. The two grooves 300, 304 can have the same groove configuration or have different groove configurations. As shown, each groove has two sidewalls and a tapered bottom wall located therebetween. The groove width is smaller than the major axis of the spring coils that it accommodates in order to rotate the spring in contrast with a groove width that is the same or wider to not rotate the spring, as shown in FIGS. 11 and 12.

A first component 112 is placed in electrical contact with a second component 114 through the FTF contact assembly of FIG. 17. The first and second components 112, 114 may be any number of electronic components or devices that are to electrically communicate with one another, such as two PCBs. As shown, the width or height of the retainer band 330 is such that it contacts the first and second components 112, 114. However, the springs 102, 104, prior to mounting the first component 112, project above the height of the retainer band 330 and are loaded or biased downwardly by the first component 112 up to the restraint of the retainer band 330, except for where the retainer band is compressible. This loading provides for a positive contact between the springs and the electrical terminals or traces 332 on the first component 112 and can be selected in view of the spring force versus deflection characteristics for canted coil springs. Other connectors discussed elsewhere herein are understood to inherently include similar capabilities. While the isolation band 328 is shown spaced from the first component 112, air is an adequate isolator between the first spring 102 and the second spring 104 so long as the band separates the first spacer element part 324 from the second spacer element part 326 and no continuous electrical path is provided.

The second component 114 is placed in abutting contact with the first spacer element part 324 and the second spacer element part 326, which are conductive and are separated or isolated from one another by the non-conductive band 328. External force or pressure, such as brackets, fasteners, and the opposing compressive force on the springs 102, 104 by the first component 112, etc., may be used to ensure adequate contacts between the traces or terminals 332 of the second component 114 and the first spacer element part 324 and the second spacer element part 326.

Figure 18:
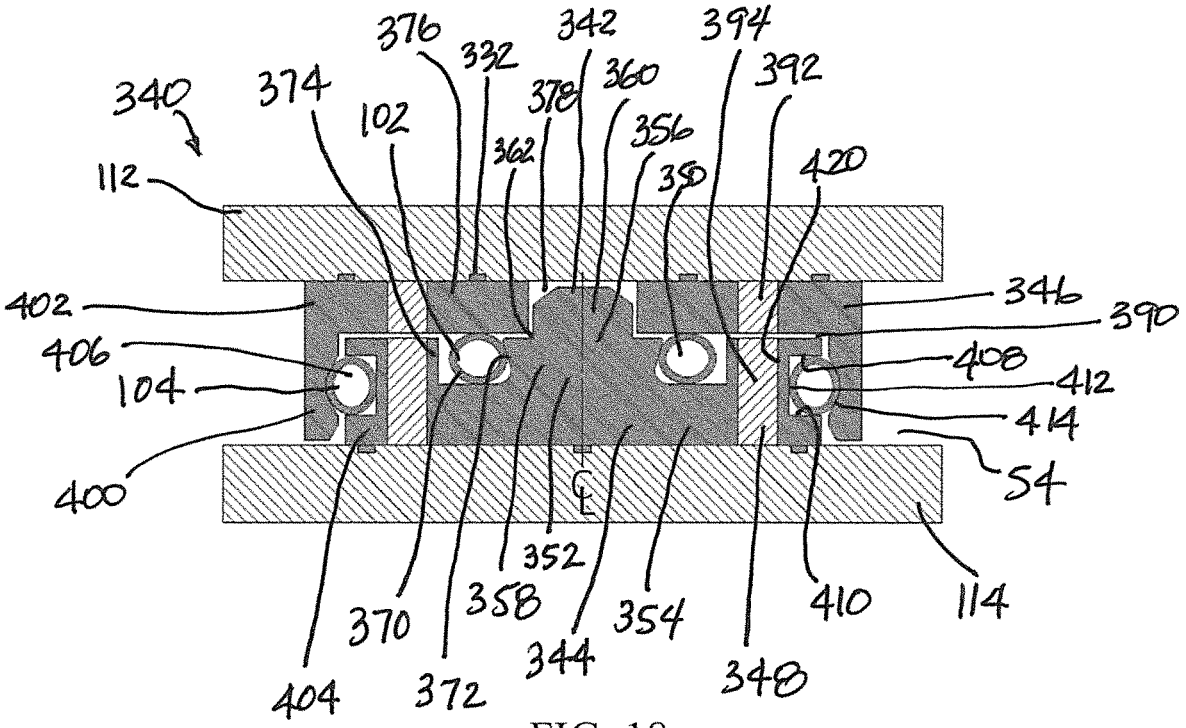
FIG. 18 shows a face to face contact assembly in which an outer spacer element has a latching connection.

FIG. 18 shows yet another FTF contact assembly 340 provided in accordance with further aspects of the present assemblies and methods. Like other contact assemblies discussed elsewhere herein, the present contact assembly 340 comprises a spacer element 342 comprising a first spacer element part 344 separated from a second spacer element part 346 by a band 348. Although not shown, a retainer band such as an O-ring, gasket, or spring energized lip seal, may be used to seal the gap 54 between the first component 112 and the second component 114.

Refer initially to the first spacer element part 344, an internal groove 350 is provided for accommodating the conductive spring element 102. The first spacer element part 344 has a spacer base 352 comprising a base plate 354, a base projection 356 having a first projection section 358 and a second projection section 360 separated from one another by a shoulder 362. The second projection section 360 may incorporate a tapered nose end to facilitate insertion into a plate, as further discussed below. A recessed section 370 is formed between the base plate 354 and the first projection section 358, which defines part of the groove 350. In one example, a sidewall 372 on the first projection section 358 is generally straight or vertical, such as being parallel to the centerline, ℄. The straight sidewall, when incorporated, allows the spring element 102, which can be an axial canted coil spring, to be positioned therein and not affect the turning angle of the spring. As shown, the sidewall 372 is tapered.

The tapered sidewall causes the conductive spring element 102 to slightly turn. In other examples, the tapered sidewall can be adjusted to turn the spring less than shown or even more. A rim 374 extends from the base plate 354, which serves as an outside sidewall for the groove 350. In an alternative embodiment, the rim 374 is omitted or a shorter rim is incorporated than as shown.

A spacer plate 376 is provided with a bore 378, which is sized and shaped to receive the second projection section 360. The spacer plate 376 has a lower surface for abutting contact with the conductive spring element 102 and an upper surface for abutting contact with the first component 112. As shown, the upper surface contacts the trace or terminal 332 on the first component 112. Electrical communication between the first component 112 and the second component 114 flows through the trace or terminal 332 of the first component, through the conductive spring element 102, through the first spacer part 344, then through the trace or terminal of the second component 114.

The band 348, which is made from a dielectric material, has a gap 390, which separates the band into a first section 392 and a second section 394. In one example, the two sections 392, 394 are the same size and configuration. Preferably, the two sections 392, 394 are split along the same thickness dimension as the spacer plate 376. Thus, as shown, the second section 394 is longer than the first section 392 and is provided to match the thickness of the spacer plate 376. The gap 390 between the two sections 392, 394 may completely shut or close when the connector is in used and placed between the first component 112 and the second component 114. More typically, the gap remains during installation as air is understood to provide adequate isolation for the first spring 102 and the second spring 104.

In the present embodiment, the second spacer element part 346 is configured as a latching connector. As shown, the second spacer element part 346 has a pair of mating blocks 400, which includes an exterior block 402 and an interior block 404 defining a groove 406 therebetween. As shown, the groove 406 is rotated so that the two sidewalls 408, 410 are generally parallel with the first and/or second components 112, 114 and the bottom wall 412 is generally parallel to the centerline of the assembly.

The interior block 404 along with the shielding spring 104 projects into a bore defined by the exterior block 402, which has a groove 414 that the spring 104 snaps into to form a latching connection. In the example shown, the groove 414 is generally arcuate or C-shape. The shielding spring 104 shown is a radial canted coil spring and biases against the two grooves. In the configuration shown, the biasing force of the shielding spring 104 pushes the exterior back surface 420 of the interior block 404 against the band 348 to ensure adequate contact or connection between the two. In other examples, the groove 406 can be modified to incorporate tapered surfaces to rotate the position of the shielding spring 104. The connection between the two grooves 406, 414 and the spring 104 is understood to be a latching connection and permits the interior block 404 to separate from the exterior block 402 even after assembly.

Figure 19:
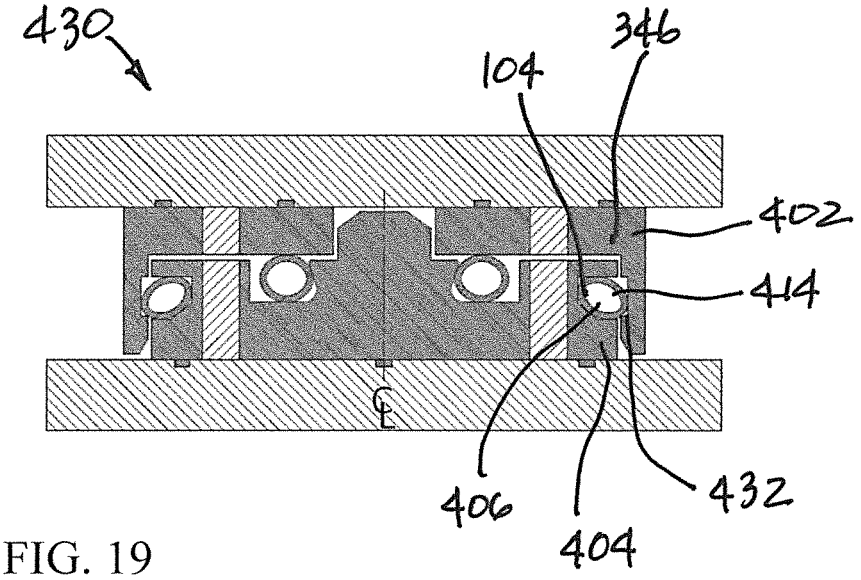
FIG. 19 shows a face to face contact assembly in which an outer spacer element has a locking connection.

With reference now to FIG. 19, a face to face contact assembly 430 provided in accordance with yet another aspect of the present disclosure is shown. The present contact assembly 430 is similar to the contact assembly 340 of FIG. 18 with a few exceptions. In the present embodiment, the second spacer element 346 incorporates an interior block 404 comprising a groove 406 having a taper surface and the exterior block 402 incorporates a groove comprising at least one straight sidewall 432.

The groove 406 in the interior block 404 is structured to receive a shielding spring 104 that is an axial canted coil spring and rotating the spring so that its major axis is angled from orthogonal to the centerline of the assembly. After assembly of the various components as shown in FIG. 19, the groove 414 on the exterior block 402 is sized and shaped so that the at least one straight sidewall 432 contacts the spring near an end of the major axis of the coils. And since a canted coil spring does not deflect when loaded near its major axis, the contact with the at least one straight sidewall 432 cannot lift the spring to allow the two blocks 402, 404 to separate. The connection with the two grooves 406, 414 and the spring 104 is therefore understood to be a locking connection.

Figure 20:
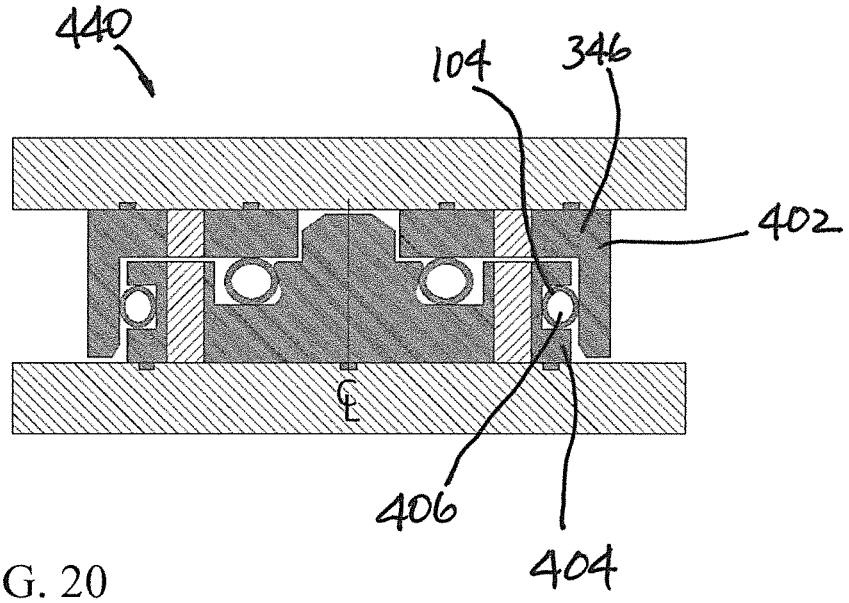
FIG. 20 shows a face to face contact assembly in which an outer spacer element has a holding connection.

With reference now to FIG. 20, a face to face contact assembly 440 provided in accordance with yet another aspect of the present disclosure is shown. The present contact assembly 440 is similar to the contact assembly 340 of FIG. 18 and the contact assembly 430 of FIG. 19 with a few exceptions. In the present embodiment, the second spacer element 346 incorporates an interior block 404 comprising a groove 406 having two sidewalls and a bottom wall for receiving a radial canted coil spring. The two sidewalls are generally parallel to one another and the bottom wall is generally parallel to the assembly centerline. The exterior block 402 does not incorporate a groove.

The groove 406 in the interior block 404 is structured to receive a shielding spring 104 that is a radial canted coil spring but does not rotate the spring. However, the groove width and either one or more sidewalls and/or the bottom wall can be tapered to rotate the spring. After assembly as shown in FIG. 20, the spring 104 biases against a flat surface provided in the bore of the exterior block 402, which is referred to as a holding connector. For a holding connector, friction force and the spring constant retain the exterior block 402 and the interior block 4040 together but which can be overcome to separate the two components.

Methods of manufacturing and method of using face to face contact assemblies as shown herein are understood to be within the scope of the present disclosure.

Although limited embodiments of face to face contact assemblies and their components have been specifically described and illustrated herein, many modifications and variations will be apparent to those skilled in the art. For example, the various spacing elements and support elements may be modified to have different shapes than described and different stacking arrangements may be provided with reference to the assembly of FIGS. 11 and 12. Furthermore, it is understood and contemplated that features specifically discussed for one contact assembly may be adopted for inclusion with another contact assembly, provided the functions are compatible. For example, the X-shape support element of FIG. 7 may be used as one of the support elements in the series of support elements in FIG. 5. Accordingly, it is to be understood that the contact assemblies and their components constructed according to principles of the disclosed device, system, and method may be embodied other than as specifically described herein. The disclosure is also defined in the following claims.

What is claimed is:

1. A face to face contact assembly comprising:

an electrically conductive canted coil spring element having an annular configuration and a shielding canted coil spring element having an annular configuration separated from one another by a band made of a dielectric material;

a spacing element comprising a first spacer element part comprising a groove having the electrically conductive canted coil spring element located therein and a second spacer element part comprising a groove having the shielding canted coil spring element located within the groove of the second spacer element part, the first spacer element part separated from the second spacer element part by the band; and wherein the annular configuration of the shielding canted coil spring element is located radially outwardly of the annular configuration of the electrically conductive canted coil spring element.

2. The face to face contact assembly of claim 1, further comprising a spacer plate pressed against the electrically conductive canted coil spring element.

3. The face to face contact assembly of claim 2, wherein the second spacer element part comprises an interior block having the groove with the shielding canted coil spring element and an exterior block, the exterior block pressed against the shielding canted coil spring element.

4. The face to face contact assembly of claim 3, wherein the exterior block comprises a groove and wherein the shielding canted coil spring element is pressed against a surface of the groove of the exterior block.

5. The face to face contact assembly of claim 3, further comprising two spaced apart electrical components in electrical communication through at least the electrically conductive canted coil spring element.

6. The face to face contact assembly of claim 5, wherein the two spaced apart electrical components have wires or electrical traces.

7. The face to face contact assembly of claim 3, wherein the exterior block comprises a generally planar surface that is larger than a width of the groove of the second spacer element part.

8. The face to face contact assembly of claim 4, wherein the groove of the exterior block comprises a straight sidewall.

9. A face to face contact assembly comprising:

an electrically conductive canted coil spring element having an annular configuration and a shielding canted coil spring element having an annular configuration separated from one another by a band made of a dielectric material;

a spacing element comprising a first spacer element part comprising a groove having the electrically conductive canted coil spring element located therein and a second spacer element part comprising a groove having the shielding canted coil spring element located within the groove of the second spacer element part, the first spacer element part separated from the second spacer element part by the band;

a spacer plate pressed against the electrically conductive canted coil spring element;

wherein the spacer plate comprises a through bore.

10. The face to face contact assembly of claim 9, wherein the groove of the first spacer element part comprises two sidewalls and a bottom wall and the groove of the second spacer element part comprises two sidewalls and a bottom wall.

11. The face to face contact assembly of claim 9, wherein the annular configuration of the shielding canted coil spring element is located radially outwardly of the annular configuration of the electrically conductive canted coil spring element.

12. A face to face contact assembly comprising:

an electrically conductive canted coil spring element having an annular configuration and a shielding canted coil spring element having an annular configuration separated from one another by a band comprising a cylindrical body with a bore;

a spacing element comprising a first spacer element part and a second spacer element part, wherein the first spacer element part comprises a groove having the electrically conductive canted coil spring element located therein and the second spacer element part comprises a groove having the shielding canted coil spring element located within the groove of the second spacer element part; and wherein the first spacer element part is located within the bore of the band.

13. The face to face contact assembly of claim 12, wherein the band is made from a dielectric material.

14. The face to face contact assembly of claim 12, further comprising a spacer plate pressed against the electrically conductive canted coil spring element.

15. The face to face contact assembly of claim 12, wherein the annular configuration of the shielding canted coil spring element is located radially outwardly of the annular configuration of the electrically conductive canted coil spring element.

16. The face to face contact assembly of claim 15, wherein the second spacer element part comprises an interior block having the groove with the shielding canted coil spring element and an exterior block, the exterior block pressed against the shielding canted coil spring element.

17. The face to face contact assembly of claim 16, wherein the exterior block comprises a groove and wherein the shielding canted coil spring element is pressed against a surface of the groove of the exterior block.

18. The face to face contact assembly of claim 16, further comprising two spaced apart electrical components in electrical communication through at least the electrically conductive canted coil spring element.

19. The face to face contact assembly of claim 18, wherein the two spaced apart electrical components have wires or electrical traces.

20. The face to face contact assembly of claim 16, wherein the exterior block comprises a generally planar surface that is larger than a width of the groove of the second spacer element part.

21. The face to face contact assembly of claim 9, wherein the through bore of the spacer plate receives a projection of the first spacer element part.

22. The face to face contact assembly of claim 21, wherein the second spacer element part comprises an interior block having the groove with the shielding canted coil spring element and an exterior block, the exterior block pressed against the shielding canted coil spring element.

23. The face to face contact assembly of claim 22, wherein the exterior block comprises a groove and wherein the shielding canted coil spring element is pressed against a surface of the groove of the exterior block.

24. The face to face contact assembly of claim 9, further comprising two spaced apart electrical components in electrical communication through at least the electrically conductive canted coil spring element.

25. The face to face contact assembly of claim 24, wherein the two spaced apart electrical components have wires or electrical traces.

26. The face to face contact assembly of claim 22, wherein the exterior block comprises a generally planar surface that is larger than a width of the groove of the second spacer element part.

27. The face to face contact assembly of claim 23, wherein the groove of the exterior block comprises a straight sidewall.

* * * * *